United States Patent [19]

Amdall

[11] 4,286,505

[45] Sep. 1, 1981

[54] OIL COOLED PISTON

[75] Inventor: John K. Amdall, Peoria, Ill.

[73] Assignee: Caterpillar Tractor Co., Peoria, Ill.

[21] Appl. No.: 85,644

[22] PCT Filed: Apr. 23, 1979

[86] PCT No.: PCT/US79/00259

§ 371 Date: Apr. 23, 1979

§ 102(e) Date: Apr. 23, 1979

[87] PCT Pub. No.: WO80/02308

PCT Pub. Date: Oct. 30, 1980

[51] Int. Cl.[3] ..... F01P 3/08

[52] U.S. Cl. ..... 92/186; 123/41.35

[58] Field of Search ..... 92/158, 159, 160, 186, 92/237, 238; 123/41.35

[56] References Cited

U.S. PATENT DOCUMENTS

| | | | |
|---|---|---|---|
| 1,430,928 | 10/1922 | Spencer . | |
| 3,009,749 | 11/1961 | Cornet . | |
| 3,104,922 | 9/1963 | Baster . | |
| 3,190,273 | 6/1965 | Bachle et al. | 92/186 X |
| 3,259,028 | 7/1966 | Hutto | 92/228 |
| 3,336,844 | 8/1967 | Cornet | 92/186 X |
| 3,452,649 | 7/1969 | Cornet | 92/232 |
| 3,987,709 | 10/1976 | Day | 92/232 |
| 4,056,044 | 11/1977 | Kamman et al. | 92/159 |
| 4,129,108 | 12/1978 | Elsbett et al. | 123/41.35 X |
| 4,175,502 | 11/1979 | Moebus | 92/186 X |

FOREIGN PATENT DOCUMENTS

| | | | |
|---|---|---|---|
| 1476393 | 4/1969 | Fed. Rep. of Germany | 123/41.35 |
| 776273 | 6/1957 | United Kingdom | 123/41.35 |

*Primary Examiner*—Irwin C. Cohen

*Attorney, Agent, or Firm*—Wegner, Stellman, McCord, Wiles & Wood

[57] ABSTRACT

Substantial heat is generated at the crown portion (18) of a piston (10). Cooling fluid has been directed to cavities (46) in the underside of the crown (18). However, at critical points of the piston cycle, the fluid drains from the cavities due to the forces of gravity. An oil cooled piston (10) is provided which includes a fluid trap (50) adjacent the crown (18). Some of the cooling fluid is trapped as it drains and is retained to enhance cooling of the crown (18). The fluid trap (50) includes a slot (60) permitting a jet spray of lubricating oil to be directed past the trap (50) to the cavities adjacent the underside of the crown (18).

4 Claims, 10 Drawing Figures

FIG. 1.
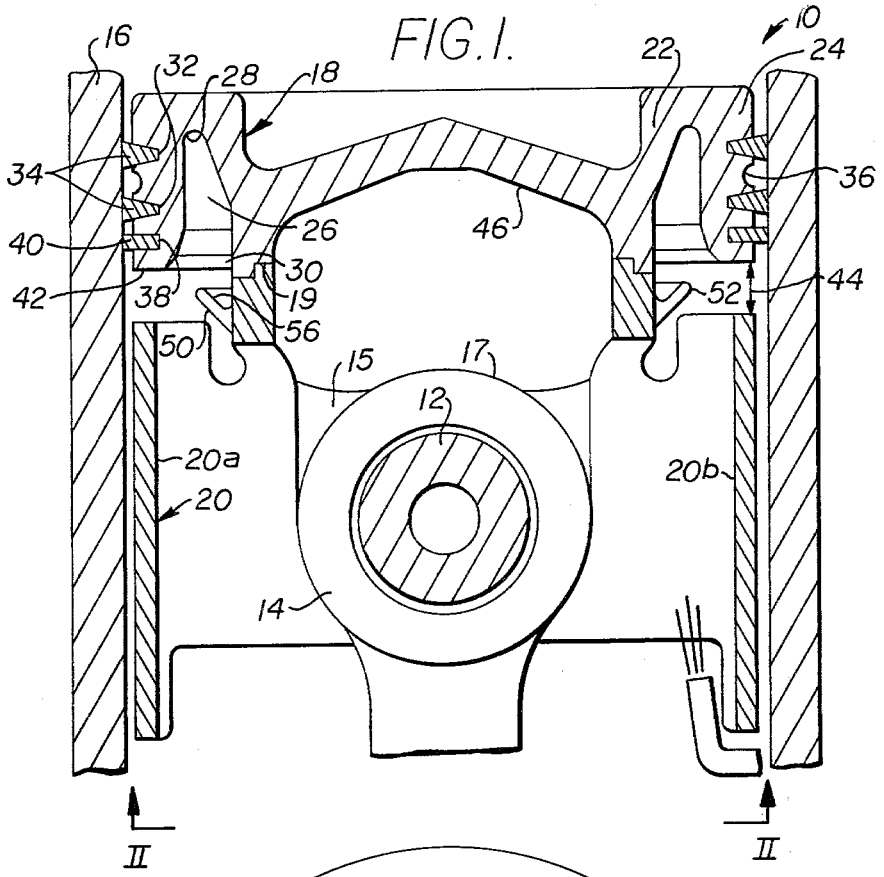
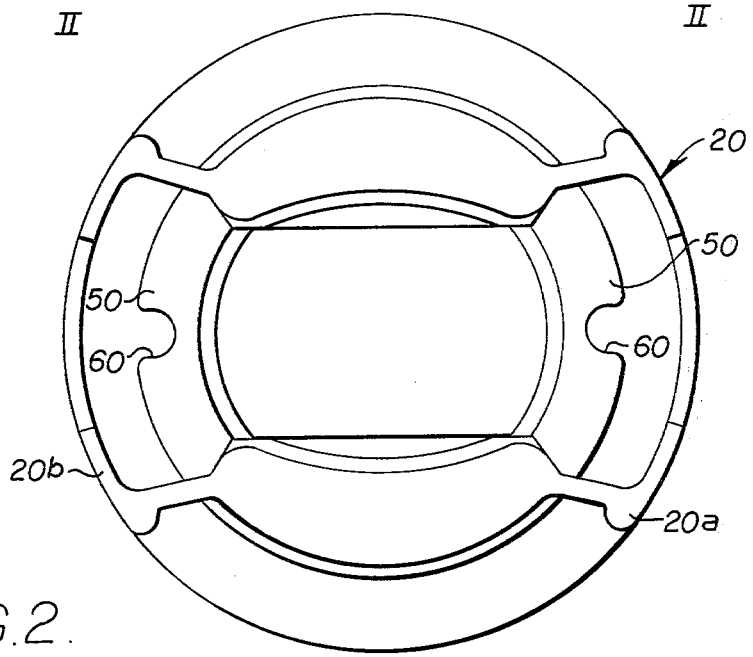
FIG. 2.

OIL COOLED PISTON

TECHNICAL FIELD

This invention relates generally to expansible chamber devices and more particularly to pistons having lubricating means including chambers or pockets.

BACKGROUND ART

In the past, lubricating oil has been sprayed upwardly into a cooling dome and an annular cooling groove adjacent the underside of the piston crown for the purpose of cooling. Also, a ledge or splash sill has been provided for trapping some of the oil and for directing the trapped oil back into the groove to supplement the oil spray.

A problem exists in that the ledge is positioned at the outer periphery of the piston which causes interference with the oil spray and which also causes poor directing of the trapped oil back into the groove.

In view of the above, it would be advantageous to provide an oil cooled piston having a ledge or splash sill which does not interfere with the spray, which better directs trapped oil back into the groove and which overcomes the problems associated with the prior art.

DISCLOSURE OF INVENTION

In one aspect of the present invention, the problems pertaining to the known prior art, as set forth above, are advantageously avoided by the present invention.

This is accomplished by providing an oil cooled piston including a crown having inner and outer annular walls. The walls define an annular groove including an annular opening. The outer wall has an end surface adjacent the opening. Means are provided for trapping fluid. Such means includes a substantially annular ledge extending from the inner wall toward the outer wall terminating at a lip. The lip is spaced from the end surface. A sloping surface on the ledge extends between the inner wall and the lip and is adjacent the annular opening.

The foregoing and other advantages will become apparent from the following detailed description of the invention when considered in conjunction with the accompanying drawings. It is to be expressly understood, however, that the drawings are not intended as a definition of the invention but are for the purpose of illustration only.

BRIEF DESCRIPTION OF THE DRAWINGS

In the drawings:

FIG. 1 is an enlarged cross-sectional view illustrating an embodiment of the present invention;

FIG. 2 is a bottom plan view taken along the line II—II of FIG. 1;

BEST MODE FOR CARRYING OUT THE INVENTION

Figure 3:
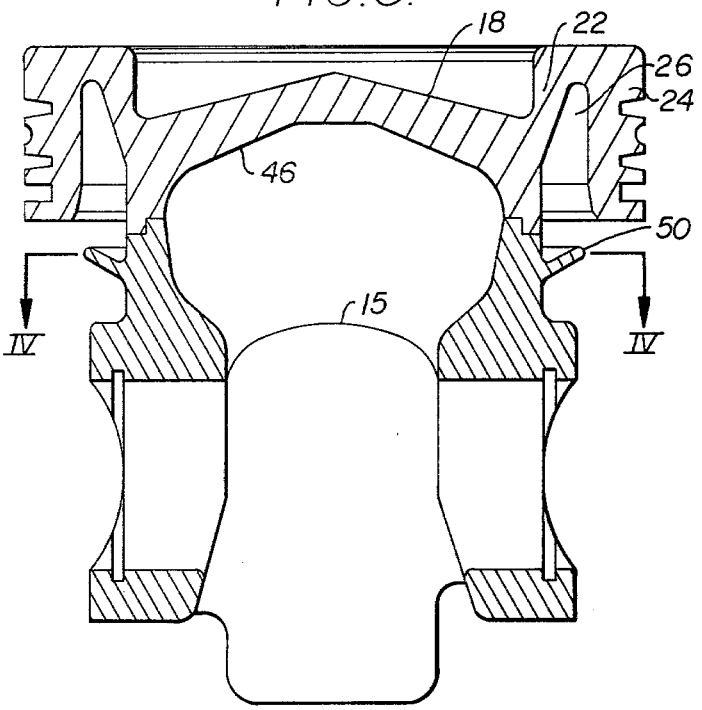
FIG. 3 is another enlarged cross-sectional view illustrating an embodiment of the present invention.

A piston is generally designated 10, FIG. 1, for reciprocating motion due to pin 12 and connecting rod 14 attached to piston boss 15 at one end 17 and to a crankshaft (not shown) at an opposite end in the well known manner. Also, a conventional cylinder liner 16 is provided for guiding the reciprocating action of piston 10.

Piston 10 includes an upper crown portion 18 and a lower skirt portion 20. In this example, the lower skirt portion 20 is well known and includes partial skirts **20*a*, 20*b***.

Crown portion 18 includes inner and outer wall portions 22, 24, respectively, defining an annular groove 26 closed at an upper end 28 and having an opening at a lower end 30. Outer wall 24 includes conventional grooves 32 carrying compression rings 34. An annular relief 36 is provided between rings 34 and a relief 38 is provided below rings 34 for carrying oil control ring 40.

Outer wall 24 terminates at end surface 42 just below oil control ring 40. Skirt portion 20 is just below end surface 42 and spaced therefrom by an opening 44.

Inner wall 22 separates groove 26 from crown 18 and cooling dome 46. Wall 22 extends downwardly past opening 44 to pin boss 15.

Piston 10 is preferably cast from iron to form a thin-walled, light-weight, one-piece unit. However, upper dome portion 18 could be cast separately from lower skirt portion 20 and the portions could then be welded together at 19 by a brazing process if desired.

Figure 9:
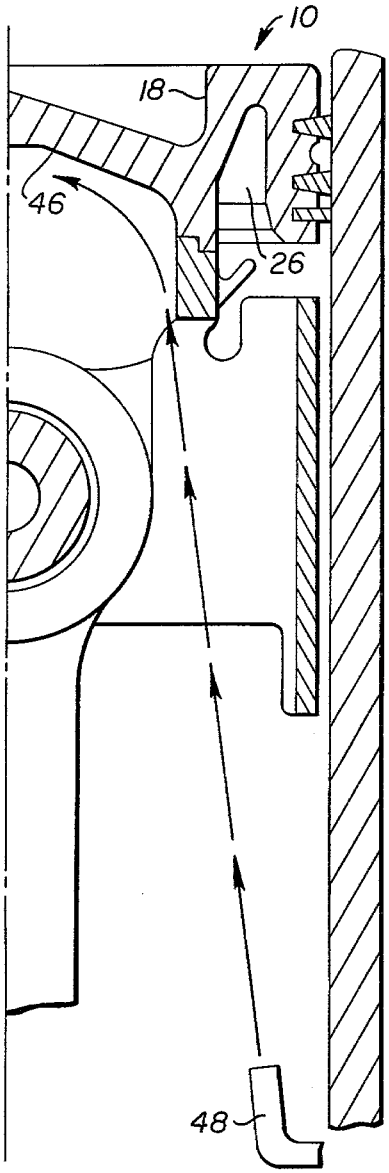
FIGS. 9, 10 are enlarged partial cross-sectional views illustrating a cooling oil spray during the piston stroke.
Figure 10:
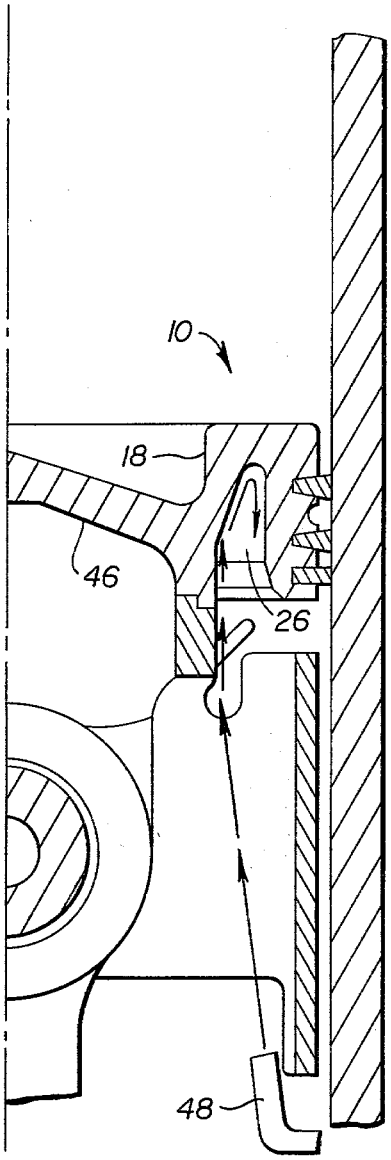

A conventional piston cooling jet 48 is fixedly positioned adjacent lower skirt 20 for spraying a jet of fluid such as lubricating oil upwardly into annular groove 26 and cooling dome 46 as is known. The jet, FIGS. 9, 10, constantly sprays the oil upwardly to the underside of the crown 18. The spray is directed so that when the piston is bottom dead center or when the reciprocating piston 10 is at its lowermost position relative to the fixed jet 48, the spray bathes and cools groove 26 which has become heated due to proximity to crown 18. When the piston 10 is at top dead center, the spray bathes and cools dome 46. This momentary cooling is advantageous but does not continuously cool both the groove 26 and the dome 46.

Figure 5:
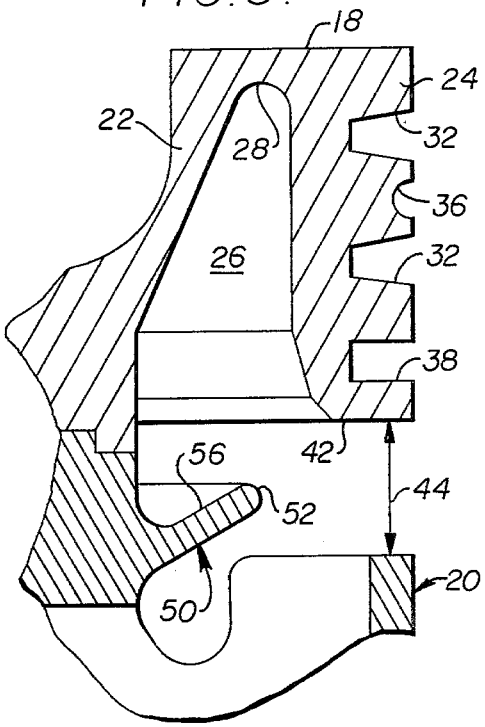
FIG. 5 is an enlarged partial cross-sectional view illustrating the preferred embodiment of this invention.
Figure 6:
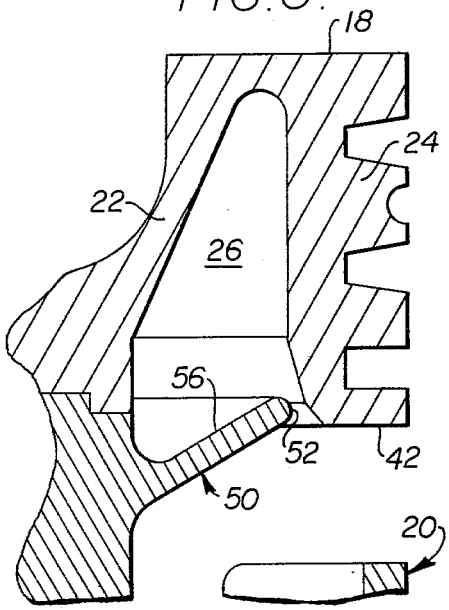
FIGS. 6–8 are enlarged partial cross-sectional views illustrating alternative embodiments of this invention.
Figure 7:
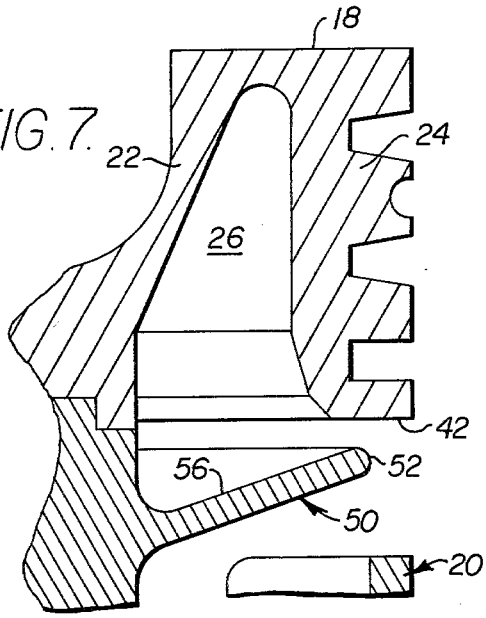

To enhance cooling, well known splash sills have been used to trap the oil as it drains downwardly and thereafter cause a secondary splash of trapped oil from the sill into the groove as the piston 10 begins its downward stroke. An improved splash sill 50, FIGS. 5–8, is provided as a means for trapping oil. Sill 50 is formed as a substantially annular ledge extending radially outwardly from inner wall 22 adjacent opening 44 and reaching toward outer wall 24. Ledge or sill 50 also extends axially upwardly toward crown 18. Ledge 50 terminates at lip portion 52 which is spaced from end surface 42. The preferred configuration for ledge 50 is illustrated in FIG. 5.

Figure 8:
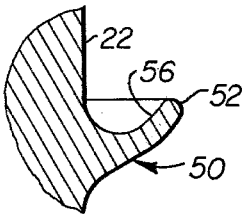

A sloping upper surface 56 is provided on ledge 50. Surface 56 may be of a substantially constant slope such as that shown in FIGS. 5–7 or may be curved or cup-shaped such as is shown in FIG. 8. Surface 56 provides ledge 50 with angular disposition relative to inner wall 22. Thus, ledge 50 and wall 22 cooperate to form a trough-like fluid trap.

Figure 4:
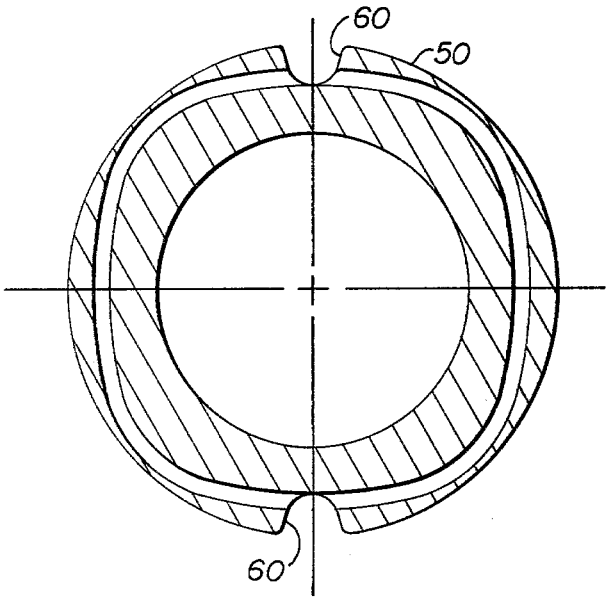
FIG. 4 is a view taken along the line IV—IV of FIG. 3.

In order to provide the maximum cooling splash for bathing groove 26, it has been discovered according to this invention, that ledge 50 is most advantageously situated as described above, that is, extending outwardly from inner wall 22 and sloped upwardly toward crown 18. However, situated as such, ledge 50 is directly in the oil jet spray path extending between jet 48 and groove 26. Advantageously, ledge 50 includes a slot 60 as a means for permitting the pressurized stream to be directed past ledge 50 and into groove 26, see FIGS. 2 and 4. As illustrated, slot 60 is formed in duplicate (two slots 60, 180 degrees diametrically opposed) for the purpose of providing a piston which can be installed without concern as to the location of slot 60. However, since only one jet 48 is usually provided, only one slot 60 is required.

INDUSTRIAL APPLICABILITY

Piston 10 reciprocates downwardly to bottom dead center and jet 48 directs lubricating oil upwardly past ledge 50 via slot 60 into groove 26. The oil bathes and momentarily cools groove 26, thereafter drains downwardly and is trapped by ledge 50 as piston 10 accelerates upwardly to its top dead center position where the oil then bathes the dome 46. As piston 10 begins to reverse direction at the top dead center position and reciprocates downward again, oil trapped between surface 56 and inner wall 22 tends to continue upwardly and is thus splashed into groove 26 thus supplementing the direct cooling from the jet spray which thereafter occurs when piston 10 once again reaches bottom dead center.

The foregoing has described an oil cooled piston having a ledge or splash sill which does not interfere with the spray of oil into the cooling groove and which better directs trapped oil back into the groove to supplement the spray.

Other aspects, objects and advantages of this invention can be obtained from a study of the drawings, the disclosures and the appended claims.

I claim:

1. An oil cooled piston (10) comprising:

a crown portion (18);

inner (22) and outer (24) annular walls connected to said crown portion (18) defining an annular groove (26) including an annular opening (30), said outer wall (24) having an end surface (42) adjacent said opening (30);

means for trapping fluid and for directing trapped fluid into said annular groove (26) in response to reciprocating motion of said piston, said means being a substantially annular ledge (50) extending solely from said inner wall (22) and directed toward said outer wall (24) terminating at a lip (52) spaced from said end surface (42) and having a sloping surface (56) extending from said inner wall (22) to said lip (52), said sloping surface (56) being angularly disposed with the inner wall (22);

means (60) for permitting a pressurized stream of fluid to be directed past said ledge (50) to said annular groove (26), said means for permitting said fluid to be directed past said ledge (50) comprising at least one axially directed slot (60) formed throughout the outermost edge of said lip 52.

2. A piston comprising:

a piston crown including radially inner and outer walls joined by an end wall to define an annular groove opening away from said end wall;

a piston skirt having an open interior and joined to said piston crown;

a generally radially outwardly extending, peripheral lip mounted solely on said radially inner wall and extending at least partially across said groove toward said radially outer wall and said end wall and being spaced from said radially outer wall, the side surface of said lip facing said end wall providing an oil trapping sill and the side surface of said lip remote from said end wall facing said open interior of said piston skirt and at least partially obstructing access to said groove from said open interior; and at least one radially directed relief in said lip extending radially inwardly from the outermost edge of said lip toward said radially inner wall and through said lip between said side surfaces thereby defining an axially directed path by which a coolant stream directed through said open interior may be directed to said groove.

3. The piston of claim 2 wherein there are two of said reliefs, one located diametrically opposite of the other to allow the piston to be installed in a mechanism in either of two positions without concern for location of said reliefs.

4. In an oil cooled piston (10) having inner and outer annular walls (22, 24) connected to an upper crown portion (18), said walls (22, 24) defining an annular cooling groove (26) having an open end (30), said outer wall (24) having an end surface (42) adjacent said open end (30), the improvement comprising:

an annular ledge (50) of a construction sufficient for trapping oil thereon and directing it into said annular groove (26) in response to reciprocating motion of said piston (10), said annular ledge (50) extending solely from said inner wall (22) and directed toward said outer wall (24) and terminating at a lip (52), said annular ledge (50) having an upwardly sloping surface (56) extending radially outwardly to said lip (52) adjacent said open end (30) of said annular groove (26), said annular ledge (50) being located elevationally below the end surface (42) of the outer wall (24) and with said lip (52) including axially directed slot means at the outermost edge of said lip to permit a stream of oil to be directed to said annular groove (26) from elevationally below said annular ledge (50).

* * * * *